US007534974B2

(12) United States Patent
Sun

(10) Patent No.: US 7,534,974 B2
(45) Date of Patent: May 19, 2009

(54) SLIDE SWITCH

(75) Inventor: Liang Sun, Shenzhen (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 91 days.

(21) Appl. No.: 11/725,690

(22) Filed: Mar. 20, 2007

(65) Prior Publication Data

US 2007/0215450 A1 Sep. 20, 2007

(30) Foreign Application Priority Data

Mar. 20, 2006 (TW) ..... 95204560 U

(51) Int. Cl.
*H01H 15/06* (2006.01)

(52) U.S. Cl. ..... 200/550; 200/547

(58) Field of Classification Search ..... 200/293–296, 200/303–307, 537, 547, 549, 550
See application file for complete search history.

(56) References Cited

U.S. PATENT DOCUMENTS 3,947,391 A * 3/1976 Lutzenberger ..... 200/16 D
4,180,712 A * 12/1979 Lutzenberger et al. .... 200/16 D
4,185,176 A * 1/1980 Matsuo ..... 200/16 D
4,514,609 A * 4/1985 Fricke et al. ..... 200/532
5,329,083 A * 7/1994 Lai ..... 200/302.2
5,557,081 A * 9/1996 Clevenger et al. ..... 200/16 C
5,969,309 A * 10/1999 Nishimura et al. ..... 200/16 C
6,621,018 B1 * 9/2003 Chen ..... 200/16 C
6,841,744 B1 * 1/2005 Kodo et al. ..... 200/16 C
6,849,817 B2 * 2/2005 Takata et al. ..... 200/339

* cited by examiner

*Primary Examiner*—Michael A Friedhofer
*Assistant Examiner*—Lisa N Klaus
(74) *Attorney, Agent, or Firm*—Wei Te Chung

(57) ABSTRACT

A slide switch (100) comprises a housing (1), a plurality of stationary contacts (2) embedded in the housing, a slide member (4) moveably contained in the housing, a moveable contact (3) fixed to the slide member, and a cover (5) attached to the housing. The housing comprises a bottom surface (10) and a plurality of side surfaces (11) therearound, and said bottom surface and side surfaces cooperatively define a cavity. The moveable contact is fixed to said slide member to be connected to and disconnected from said stationary contacts. Each end of the housing defines a pair of protrusions (131) at upper portions of two lateral sides thereof, and therefore a channel is formed between said two protrusions. A pair of recesses (133) is defined below the protrusions respectively, and the recesses are recessed into the side surface of the end/channel.

13 Claims, 5 Drawing Sheets

SLIDE SWITCH

BACKGROUND OF THE INVENTION

1. Field of the Invention

The present invention relates to a slide switch for use in various electronic devices such as portable telephones and digital cameras.

2. General Background

Nowadays, slide switches are widely used in various electronic devices such as portable telephones and digital cameras.

As shown in FIGS. 4-5, the conventional slide switch 100' generally comprises an insulative housing 1', a plurality of stationary contacts 2' fixed in the housing, a slide member 4' moveable mounted onto the housing, a moveable contact 3' fixed onto the slide member, and a cover 5' covering the housing and the slide member.

The housing 1' has a substantially longitudinal configuration with a top opening, and the housing comprises a bottom surface 10' and a plurality of side surfaces 11' around said bottom surfaces. Said bottom surface and side surfaces cooperatively define a cavity for accommodating the slide member. The stationary contacts are embedded in the bottom surface of the housing. The slide member 4' comprises a containing portion 42' recessed in the cavity substantially in the center thereof and an operating portion 41' extending out of the housing. The moveable contact 3' is fixed to a lower surface of the slide member for connecting to or disconnecting from the stationary contacts.

Each end of the longitudinal housing 1' defines a pair of protrusions 131' at upper portions of two lateral sides thereof, and therefore a channel is formed between said two protrusions 131'. The cover 5' comprises a longitudinal main body 50' and a pair of retaining portion 51' extending from two ends of the main body 50'. The retaining portion 51' comprises a connecting portion 510' and a perpendicular engaging portion 512', and said connecting portion 510' and engaging portion 512' cooperatively define an inverted "T" shaped configuration. A pair of soldering tail 52' extends from two ends of the engaging portion 512' for connecting with a printed circuit board.

In assembly, the moveable contact 3' is fixed to the slide member 4'. Then the slide member 4' is mounted into the cavity of the housing 1' from the top opening. The containing portion 42' is received in the cavity and the operating portion 41' extends out of the cavity from a cut out of the lateral side surface. When the cover 5' is mounted onto the housing 1, the main body 50' slightly attaches to the housing first. When the cover 5' is pressed downwardly, the retaining portions 51' of the cover 5' will elastic deform outwardly and the engaging portion 512' will scrape with the protrusions 131'. When the engaging portion 512' scrapes through the protrusions 131', the retaining portion 51' returns back to keep close to the side surface of the ends/channels and to engage with the lower surface of the protrusions 131'. The cover therefore is attached to the housing and the slide member for preventing EMI.

In use, the slide switch 100' is mounted onto a printed circuit board, and the stationary contacts 2' connect with corresponding circuits of the printed circuit board. At this time, the moveable contact contacts with some predetermined stationary contacts. When the operating portion is actuated from a neutral position to another predetermined position, the moveable contact contacts with some other predetermined stationary contacts in the bottom surface. When the operating portion is actuated back in an opposite direction, the slide member will return to the neutral position under the pressure of the actuation.

However, one problem with this conventional slide switch is that the scrape between the engaging portion and the protrusions will generate crumb, and said crumb drops and is probably held between the side surface of the ends and corresponding retaining portions 51'. Therefore, the cover may not be mounted onto the housing tightly and reliable mechanical performance of the slide switch is reduced.

In view of the above, a new slide switch which overcomes the above-mentioned disadvantages is desired.

SUMMARY

Accordingly, an object of the present invention is to provide a slide switch that can provide space for accommodating the protrusion crumb generated by the scrape between the engaging portion and protrusions, therefore ensuring reliable mechanical performance of the slide switch.

A slide switch comprises a housing, a plurality of stationary contacts embedded in the housing, a slide member moveably contained in the housing, a moveable contact fixed to the slide member, and a cover attached to the housing. The housing comprises a bottom surface and a plurality of side surfaces therearound, and said bottom surface and side surfaces cooperatively define a cavity. The moveable contact is fixed to said slide member to be connected to and disconnected from said stationary contacts. At lease one side surface of the housing defines a pair of protrusions at upper portions of two lateral sides thereof, and therefore a channel is formed between said two protrusions. A pair of recesses is defined below the protrusions respectively, and the recesses are recessed into the side surface of the end/channel. When the cover mounts onto the housing, the crumb generated by the scrape between the cover and the protrusions will drop into the cavity, and the engagement between the housing and the cover will not be affected by the crumb. Therefore reliable mechanical performance of the switch is ensured.

Other objects, advantages and novel features of the invention will become more apparent from the following detailed description when taken in conjunction with the accompanying drawings, in which:

DETAILED DESCRIPTION OF THE PREFERRED EMBODIMENT OF THE INVENTION

Reference will now be made to the drawings to describe the present invention in detail.

Figure 1:
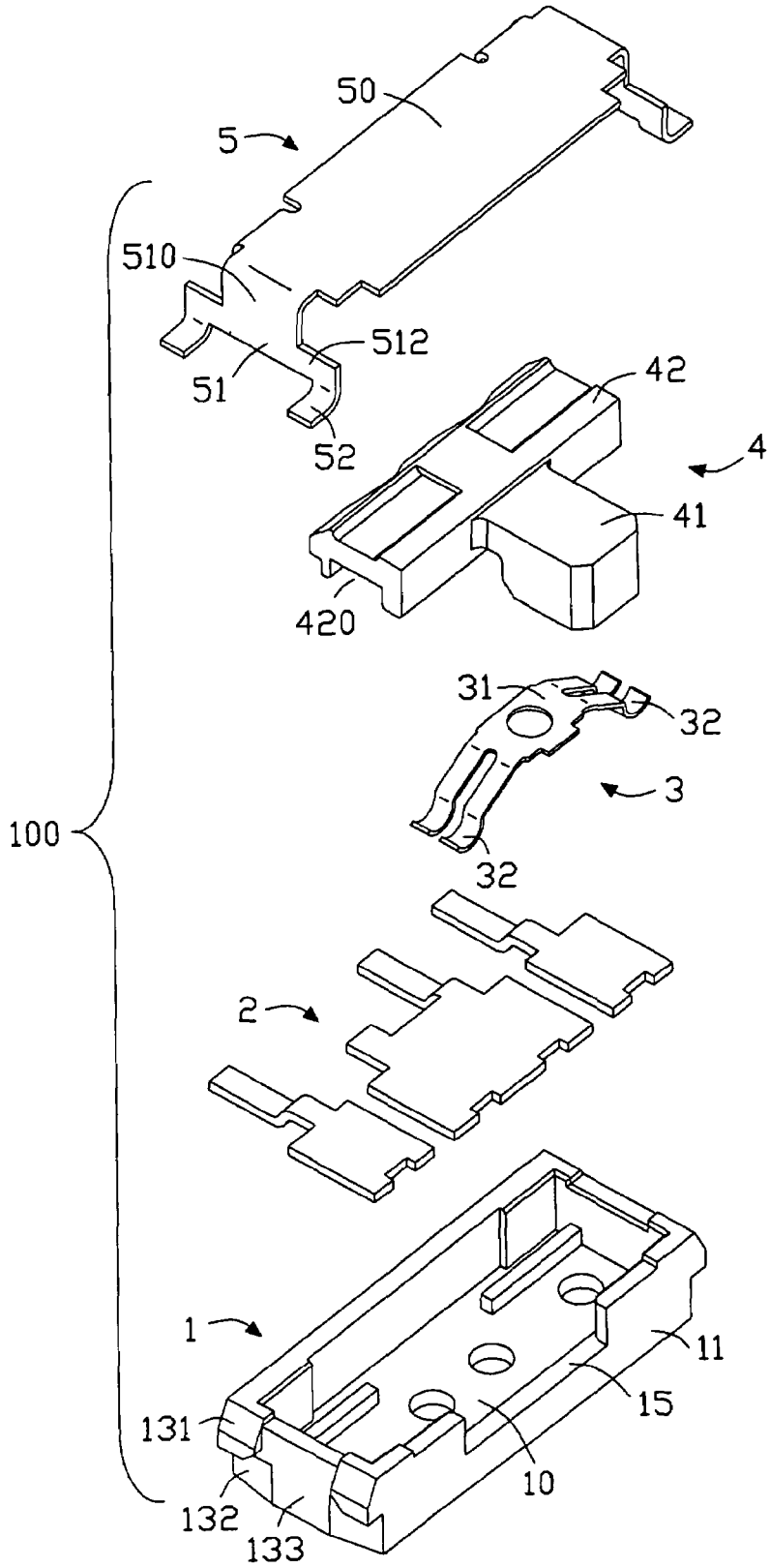
FIG. 1 is an exploded, isometric view of a slide switch in accordance with the preferred embodiment of the present invention.
Figure 2:
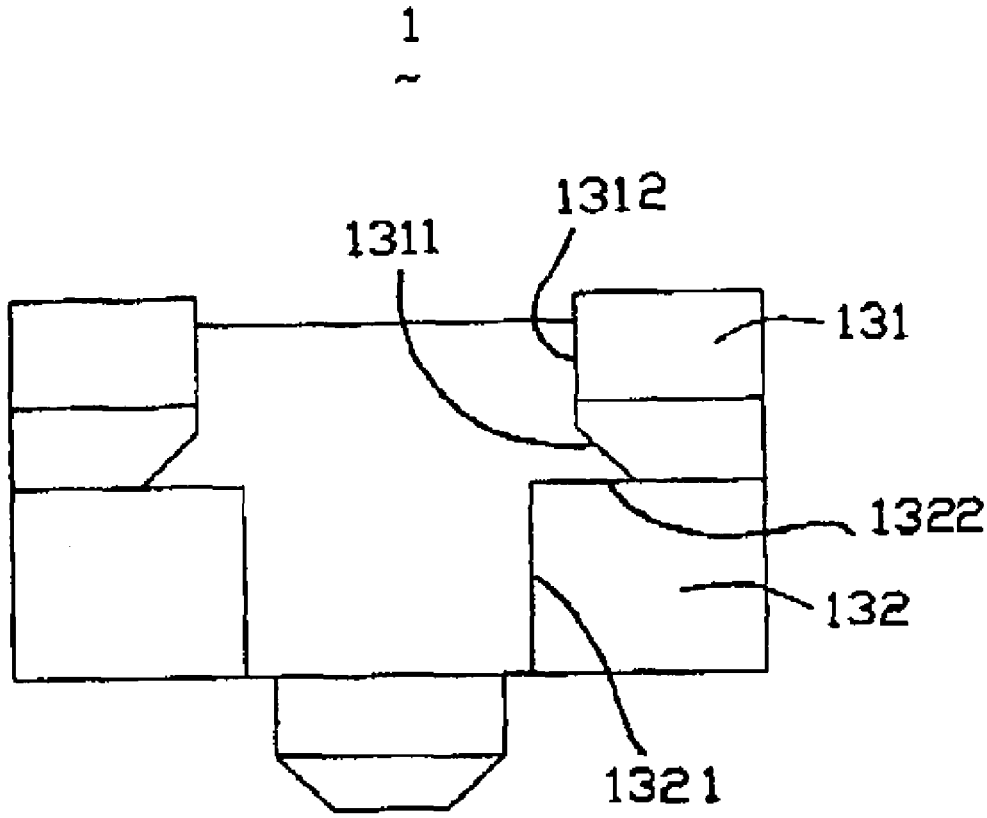
FIG. 2 is a side plan view of the housing in FIG. 1.
Figure 3:
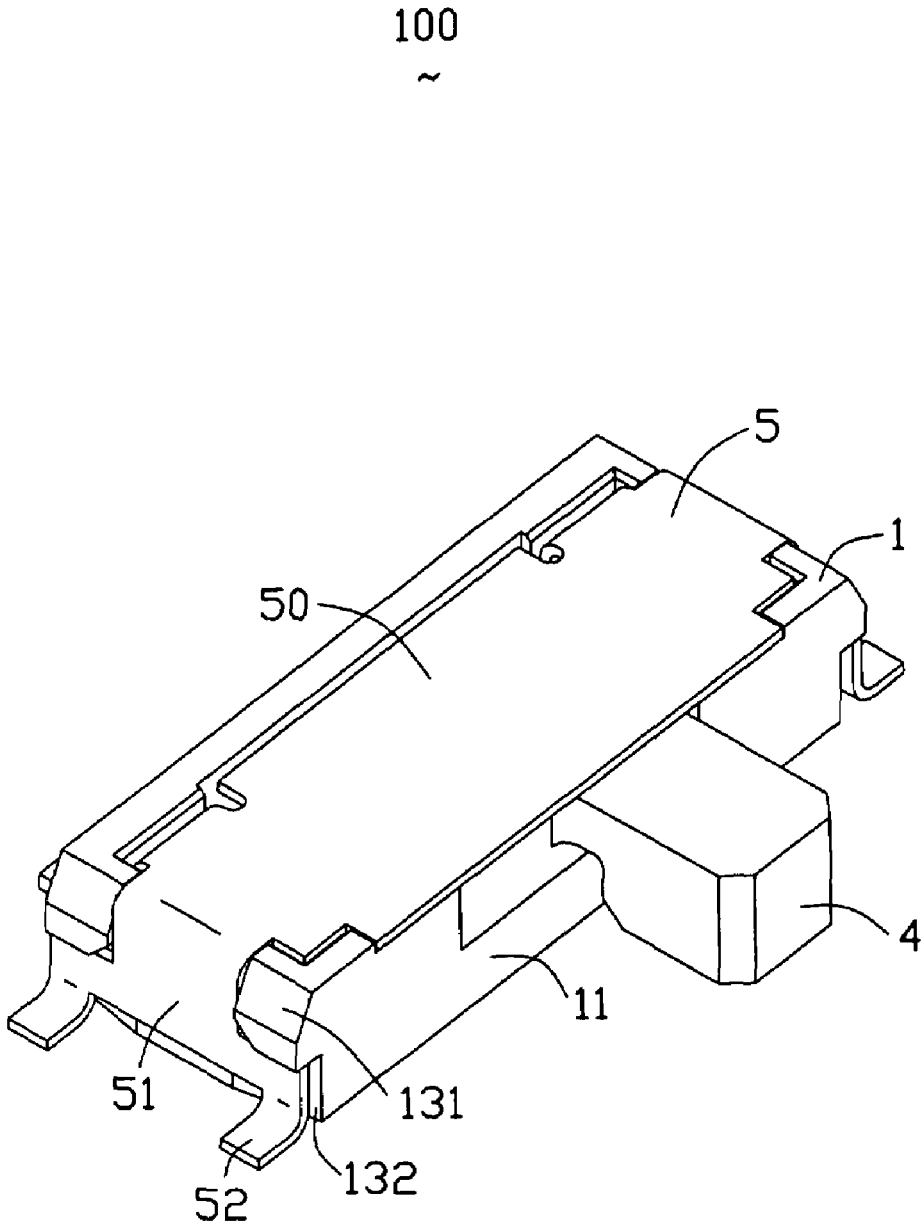
FIG. 3 is an isometric view of the assembled slide switch of FIG. 1.
Figure 4:
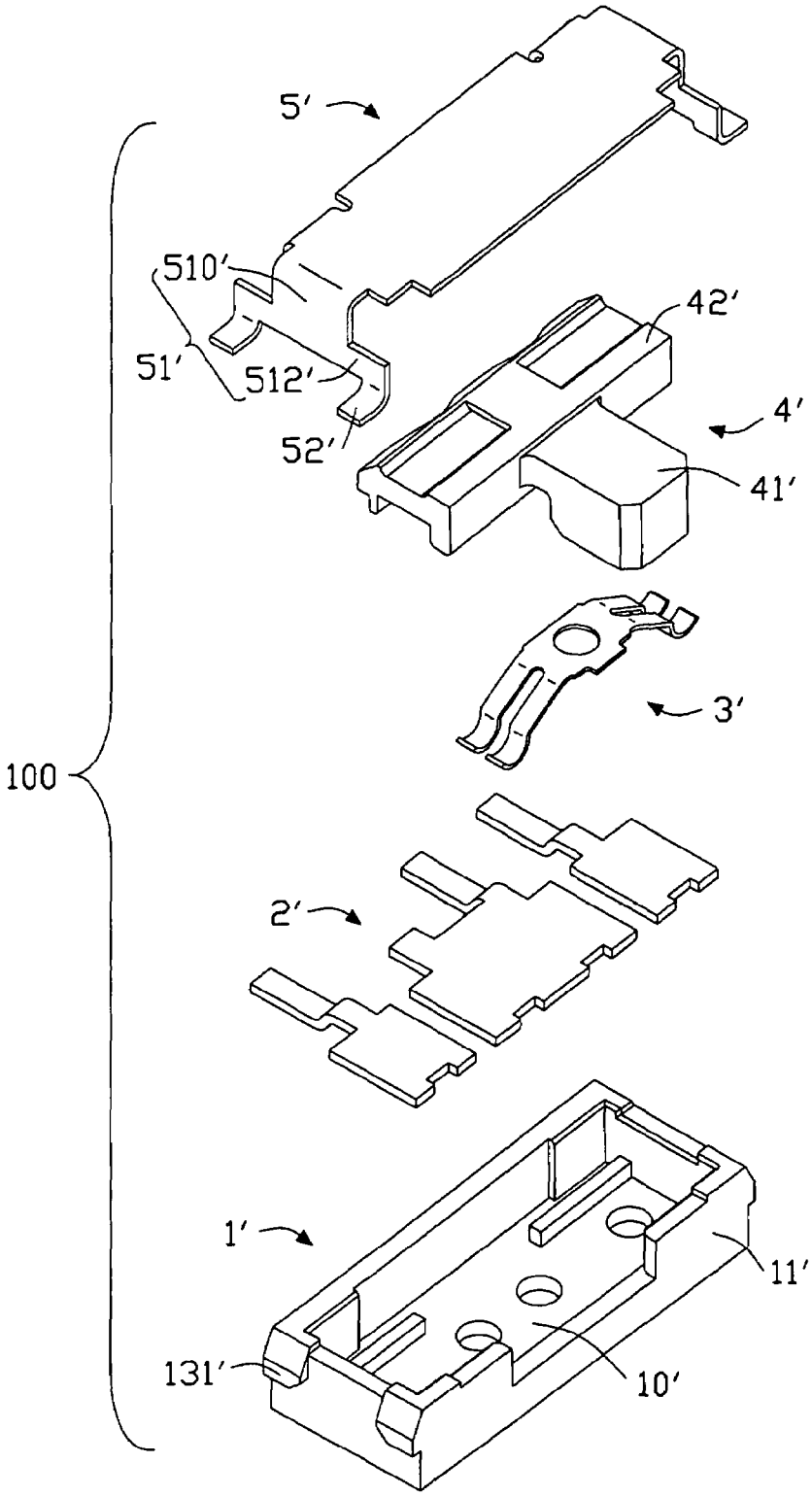
FIG. 4 (Related Art)
FIG. 4 is an exploded, isometric view of a conventional slide switch.
Figure 5:
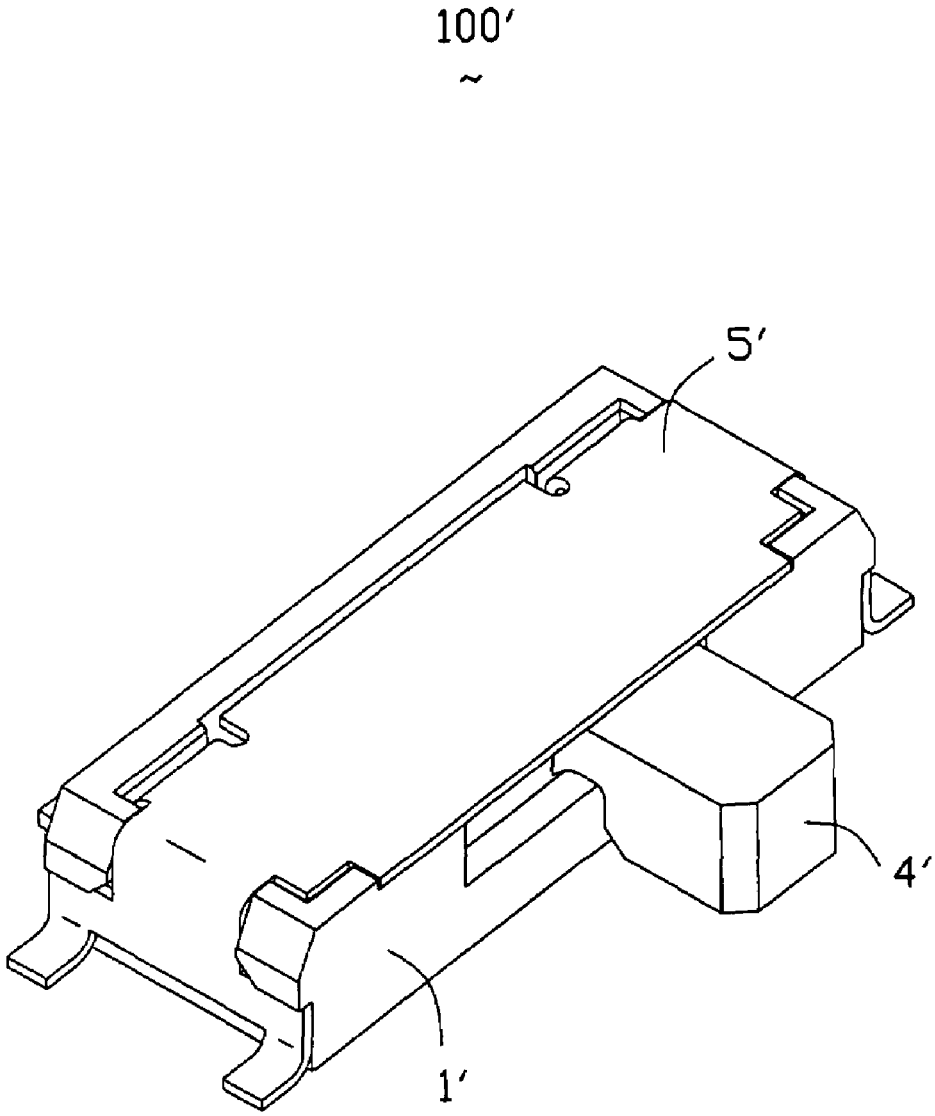
FIG. 5 (Related Art)
FIG. 5 is an isometric view of the assembled slide switch of FIG. 4.

Referring to FIGS. 1-3, a slide switch 100 in accordance with the preferred embodiment of the present invention comprises a housing 1 with a bottom surface 10 and a plurality of side surfaces 11 around the bottom surface, a plurality of stationary contacts 2 embedded in the bottom surface of the housing 1, a slide member 4 moveably contained in the housing, a moveable contact fixed onto the slide member, and a cover 5 attached to the housing 1. The moveable contact 3 is fixed to said slide member 4 to be connected to and disconnected from said stationary contacts 2.

The housing 1 has a longitudinal configuration. The bottom surface 10 and the side surface 11 cooperatively define a cavity (not shown) with a top opening. One of the longitudinal side surfaces 11 defines a cut out 15 substantially at the middle thereof. The stationary contacts 2 are embedded in the bottom surface along the longitudinal direction. Each end of the housing 1 defines a pair of protrusions 131 at upper portions of two lateral sides thereof, and therefore a channel 133 is formed between said two protrusions 131. Each end of the housing further defines two recesses 132 below the protrusions 131, and the recesses 131 are recessed into the side surface of the end/channel 133. Additionally, a rib is formed on the bottom surface 10 of the housing 1, and the rib extends along the longitudinal direction.

The slide member 4 comprises an operating portion 41 and a containing portion 42 recessed in the cavity substantially in the center thereof. The containing portion 42 defines a longitudinal recess 420 in a lower surface thereof along the longitudinal direction for fixing and accommodating the moveable contact 3 therein. The recess defines two opposite side walls called first and second side wall, wherein the first side wall connecting with the operating portion. The first side wall defines an inner surface opposite to the second side wall and an outer surface opposite to the inner surface, and the second side wall defines an inner surface opposite to the inner surface of the first side wall and an outer surface opposite to the inner surface. When the slider member 4 is assembled into the housing, the outer surface of the second side wall abut against a side surface of the rib and the outer surface of the first side wall abut against the inner surface the side surface of the housing. Therefore, the slider member is disposed on a region formed between the rib and the side surface of the housing. The moveable contact 3 is slightly bent and comprises a center fixing portion 31 and two contacting portions 32 at both ends thereof, and the distal end of the contact portion curing upwardly and being a semi-circle shape. The moveable contact 3 can move along with the slide member 4 for connecting to or disconnecting from some predetermined stationary contacts 2.

The cover 5 comprises a longitudinal main body 50 and a pair of retaining portion 51 extending from two ends of the main body 50. The retaining portion 51 comprises a connecting portion 510 and a perpendicular engaging portion 512, and said connecting portion 510 and engaging portion 512 cooperatively define an inverted "T" shaped configuration. A pair of soldering tails 52 extends from two ends of the engaging portion 512 for connecting with a printed circuit board (not shown).

In assembly, the moveable contact 3 is fixed to the recess 420 of the containing portion 42 via the center fixing portion 31. Then the slide element 4 is mounted into the housing from the top opening, with the containing portion 42 received in the cavity and the operating portion 41 extending out of the housing from the cut out 15 of the lateral side surface 11. When the cover 5 is mounted onto the housing 1, the main body 50 slightly attaches to the housing first. When the cover 5 is pressed downwardly, the retaining portions 51 of the cover 5 will elastic deform outwardly and the engaging portion 512 will scrape with the protrusions 131. When the engaging portion 512 scrapes through the protrusions 131, the retaining portion 51 auto-returns back to keep close to the side surface of the ends/channels and to engage with the lower surface of the protrusions 131. The cover therefore is attached to the housing and the slide member for preventing EMI. During mounting of the cover onto the housing, the engaging portion 512 of the cover 5 will engage with the protrusions 131, and the scrape between the engaging portion and the protrusions will generate crumb. Said crumb drops into the recesses 132 and therefore will not be undesirably held between the side surface of the end and corresponding retaining portion 51. Therefore the retaining portion of the cover 5 can keep close to the side surfaces of the ends, and the cover can be mounted onto the housing tightly to ensure reliable mechanical performance of the slide switch.

In use, the slide switch 100 is mounted onto a printed circuit board, and the stationary contacts 2 connect with corresponding circuits of the printed circuit board. At this time, the moveable contact 3 contacts with some predetermined stationary contacts 2. When the operating portion 41 is actuated from the neutral position to another predetermined position, the moveable contact 3 contacts with some other predetermined stationary contacts 2 in the bottom surface 10. When the operating portion 41 is actuated back in an opposite direction, the slide member 4 will return to the neutral position. Therefore, different connections are achieved by different operations of the slide member.

It is noted that in the instant invention, the recess 132 starts from an inner edge 1321 and extends outwardly laterally obliquely with an upper edge 1322 formed thereabove. The protrusion 131 defines an inner edge 1312 which is located outward relative to the inner edge 1321 of the recess 132, and a chamfer 1311 extending from a bottom end of the inner edge 1312 and terminated around a middle section of the upper edge 1322 in a side view.

While preferred embodiment in accordance with the present invention has been shown and described, equivalent modifications and changes known to persons skilled in the art according to the spirit of the present invention are considered within the scope of the present invention as defined in the appended claims.

What is claimed is:

1. A slide switch comprising:

a housing comprising a bottom surface and a plurality of side surfaces therearound, said bottom surface and side surfaces cooperatively defining a cavity, a pair of protrusions defined at upper portions of two lateral sides of two ends of the housing;

a plurality of stationary contacts embedded in the bottom surface of the housing;

a slide member comprising a containing portion and an operating portion, the containing portion moveably mounted into the cavity;

a moveable contact fixed in a lower surface of the slide member;

a cover attached to the housing and the slide member, the cover comprising a main body and a pair of retaining portions extending from two opposite ends of the main body, the retaining portion comprising a connecting portion and a perpendicular engaging portion, the connecting portion and engaging portion cooperatively defining an inverted "T" configuration, said engaging portion engaging with lower surfaces of said protrusions, and said connecting portion extending through a channel formed between said protrusions;

wherein a plurality of recesses is defined below said protrusions for accommodating crumb generated by the scrape between the cover and the protrusions.

2. The slide switch as claimed in claim 1, wherein the moveable contact comprises a fixing portion and two contacting portions at both ends thereof.

3. The slide switch as claimed in claim 2, wherein the slide member defines a recess at lower surface thereof, and the moveable contact is fixed in said recess.

4. The slide switch as described in the claim 2, wherein each distal end of the contact portion of the movable contact cures upwardly and is a semi-circle shape.

5. The slide switch as described in the claim 4, wherein the slider member defines a recess on the under side of the containing portion to receive the movable contact.

6. The slide switch as described in the claim 5, wherein the bottom surface of the housing defines a rib substantially extending upwardly, and the slider moved on a region formed between the rib and the side surface of the housing.

7. A slide switch comprising:

an insulative housing defining a least one protrusion on an exterior face;

a plurality of fixed contacts disposed in the housing;

a slide member mounted in the housing so as to actuate at least one movable contact to selectively engage at least one of the fixed contacts; and a metallic cover defining an engaging portion to be latched to an underside of the protrusion; wherein the exterior face defines a region under each of said protrusions, and the engaging portion does not intimately abut against the region but with a gap formed therebetween so as to forgive crumbs due to scraping; wherein said gap is formed by a recess in the exterior face; wherein the recess starts from an inner edge and extends outwardly laterally obliquely with an upper edge formed thereabove, the protrusion defines an inner edge which is located outward relative to the inner edge of the recess, and a chamfer extending from a bottom end of the inner edge and terminated around a middle section of the upper edge in a side view.

8. A slide switch comprising:

a housing at least including a plurality of side walls, a pair of protrusions extending outwardly from a outer surface of the side wall, and a groove disposed between the protrusions;

a plurality of fixed contacts embedded into the housing;

a slider member including a containing portion moveable mounted into the housing and operating portion extending outside of the housing;

a moveable contact disposed on bottom surface of the slider member;

a cover attached to the housing comprising a main body and a pair of retaining portion, and a connecting portion disposed between the main portion and the retaining portion and connecting with the retaining portion by extending through said groove; wherein a pair of recesses are defined below the protrusions and engaged with the retaining portion of the cover.

9. The slide switch as described in claim 8, wherein the protrusions are defined at upper portions of two lateral sides of two ends of the housing.

10. The slide switch as described in claim 9, wherein the retaining portion further includes an engaging portion perpendicular to the connecting portion, and the engaging portion and the connecting portion cooperatively define an inverted "T" shaped configuration.

11. The slide switch as described in claim 10, wherein the retaining portion further includes a solder portion extending vertically outwardly from the distal end of the engaging portion.

12. The slide switch as described in claim 11, wherein the moveable contact moves along with the slider member.

13. The switch as described in claim 12, wherein the moveable contact at least includes a fix portion and two contact portions at both ends thereof.

* * * * *